US005083522A

United States Patent [19]

Ashrow

[11] Patent Number: 5,083,522

[45] Date of Patent: Jan. 28, 1992

[54] SWIMMING HARNESS

[76] Inventor: David P. Ashrow, 1651 N. Foothill Rd., Ojai, Calif. 93023

[21] Appl. No.: 698,929

[22] Filed: May 13, 1991

[51] Int. Cl.[5] ..... F16G 11/00

[52] U.S. Cl. ..... 114/215; 441/55; 272/71; 267/69

[58] Field of Search ..... 114/205, 213, 215, 230, 114/247; 267/69, 74, 148; 441/84, 55; 272/71

[56] References Cited

U.S. PATENT DOCUMENTS

| | | | |
|---|---|---|---|
| 2,117,322 | 5/1938 | Hillman | 267/69 |
| 2,888,257 | 5/1959 | Taylor | 267/148 |
| 3,353,817 | 11/1967 | Bollinger | 114/215 |
| 3,931,656 | 1/1976 | Thomson | 267/69 |
| 4,258,608 | 3/1981 | Brown | 114/215 |
| 4,524,711 | 6/1985 | Ashrow | 114/215 |

*Primary Examiner*—Jesûs D. Sotelo

*Assistant Examiner*—Stephen P. Avila

*Attorney, Agent, or Firm*—Jack C. Munro

[57] ABSTRACT

A swimming harness for holding a swimming at a selected location in a body of water such as a swimming pool and giving the swimmer freedom of swimming movement. The swimming harness comprises an elongated integral braided cord having an inner end which is secured to a fixed object located directly adjacent the swimming pool and an outer end which is connected, such as by a belt, to the swimmer. The elongated integral braided cord includes an enlarged section within which is mounted a stretchable resilient solid cord. The resilient cord functions to stretch to substantially eliminate any jerking movements produced by the swimmer during the swimming motion. The enlarged section of cord that surrounds the resilient solid cord is capable of being expanded a limited amount thereby functioning as a stretch limiter for the resilient solid cord.

2 Claims, 2 Drawing Sheets

SWIMMING HARNESS

BACKGROUND OF THE INVENTION

1. Field of the Invention

The field of this invention relates to the sport of swimming and more particularly to a swimming exercise device in which the swimmer is tethered to a fixed structure located directly adjacent the swimming pool permitting the swimmer to swim freely in a confined area of the swimming pool.

2. Description of Prior Art

The need and desire for exercise for a great number of people has long been known. Various apparatuses have been constructed in the past in an attempt to satisfy such needs and desires.

One of the better forms of an exercise is swimming. Commercial and private swimming pools are in widespread usage not only in the United States but throughout the world. Normally, for an individual to use swimming as an exercise requires the usage of a fairly large and costly to maintain swimming pool. Also, some areas are not conducive to construction of large swimming areas such as on board a cruise ship. In addition, within many homes, the land size is not adequate to permit the construction of a large size swimming pool but is sufficient to permit the construction of a small size of swimming pool. However, a small size swimming pool makes it very difficult for a swimmer to comfortably exercise. Normally, any swimming pool that is less than twenty-five feet in length is difficult for a swimmer to perform any kind of regular exercise program. A swimming pool length of at least thirty-five feet is preferred for such a regular exercise program.

Previously, there have been devices developed to enable a swimmer to swim in place. One such device was invented by the present inventor and carries U.S. Pat. No. 4,524,711 and is similarly titled, SWIMMING HARNESS. The inventive structure of Patent '711 is directed to utilizing a mass of knots to function as a shock absorbing device within the harness. The structure of the present invention is an improvement in the structure of this shock absorbing device.

Other known devices to be utilized for in-place swimming are U.S. Pat. No. 4,577,859, inventor Bernham Gossett, and U.S. Pat. No. 4,247,096, inventor, Larry Schmitt. However, both of these devices are quite complicated and require special installation in conjunction with the swimming pool.

SUMMARY OF THE INVENTION

One of the objectives of the present invention is to construct a swimming harness which is small in size and can be readily portable so as to be transportable to any desired location by the user such as on board a cruise ship and readily carried in the user's baggage.

Another objective of the present invention is to construct a swimming harness that can be quickly and easily installed and removed at each and every location that it is to be used not requiring any special installation of the pool area.

Another objective of the present invention is to construct a swimming harness which can be manufactured relatively inexpensively and therefore sold to the ultimate consumer at an inexpensive price.

Another objective of the present invention is to construct a swimming harness which freely and easily stretches to eliminate jerking movements which may be encountered during the completing of the swimming motion which may cause injury to the swimmer.

The structure of the present invention relates to a harness which comprises an elongated member, one end of which is to be attached to a fixed structure mounted directly adjacent the coping of the swimming pool and the opposite end of which is attached to the user as by means of a belt. The elongated member is formed of a braided construction with a desirable material being nylon. A section of the nylon cord is longitudinally condensed which results in the nylon cord forming an enlarged diametered section. The braided cord has a hollow interior and within this enlarged section this hollow interior has a much greater cross-sectional area. Located within this enlarged section and being mounted in alignment with the longitudinal center axis of the braided cord is a solid cord constructed of a readily stretchable material such as a rubber composition. The ends of the solid cord are fixedly secured to the braided cord directly adjacent the ends of the enlarged section. The portion of the braided cord mounted about the solid cord functions to limit the amount of stretching of the solid cord.

DETAILED DESCRIPTION OF THE SHOWN EMBODIMENT

Figure 1:
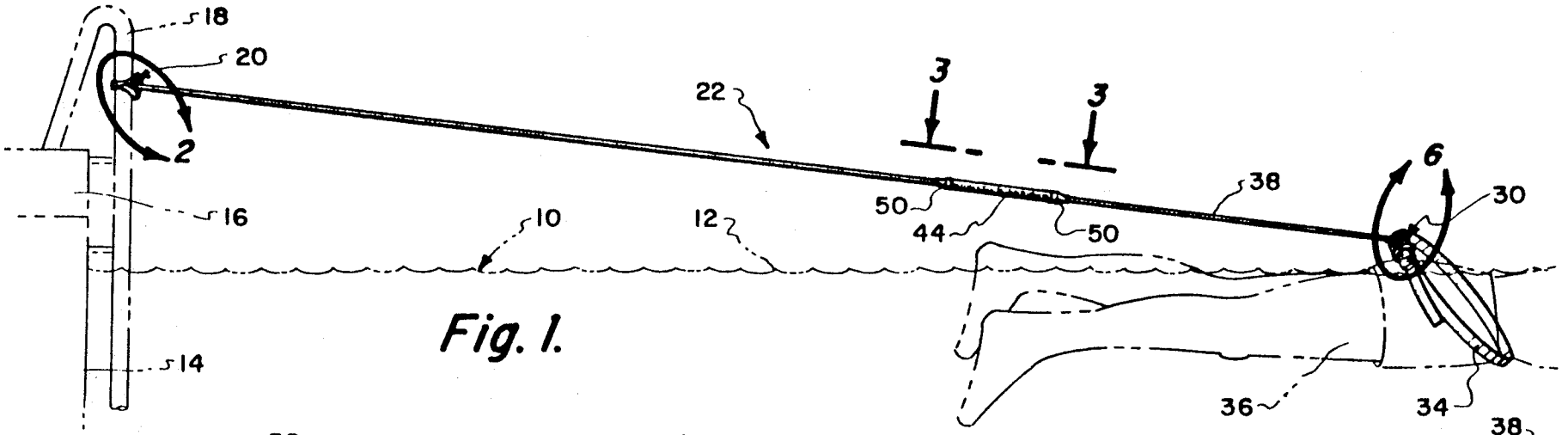
FIG. 1 is a side view of a swimming pool depicting a swimmer who is connected to the swimming harness of the present invention.
Figure 3:
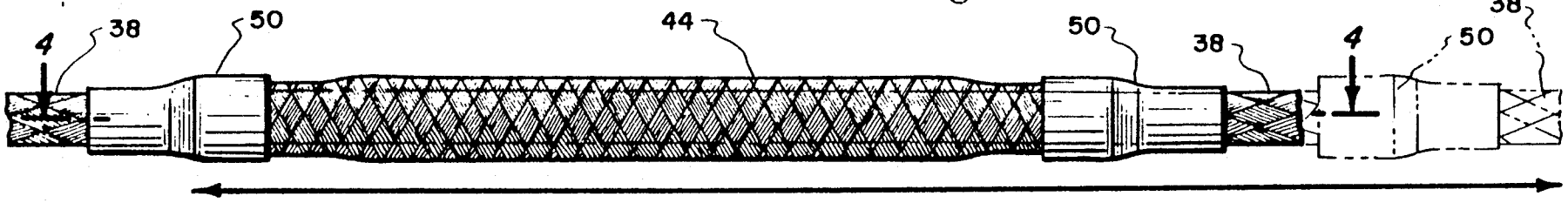
FIG. 3 is a top plan view, which is identical to both the side and bottom views, of the enlarged section which is incorporated within the swimming harness of the present invention.

Referring particularly to the drawings, there is shown a conventional swimming pool 10 which contains water 12 and has a side wall 14 which terminates in a coping 16. Attached to the coping 16 and the side wall 14 is a fixed object such as a ladder 18. The inner end 20 of the swimming harness 22 of this invention is shown secured to the ladder 18. The inner end 20 is formed into a loop 24 through which is conducted the remaining portion of the swimming harness 22. The swimming harness 22 is to be construted of integral braided cord 38 generally constructed of a material impervious to damage from water such as nylon.

The outer end of the swimming harness 22 is also formed into a loop 26. The loop 26 is permanently connected with the female portion 28 of a buckle 30. The buckle 30 includes a male section 34 which is to removably connect to the female section 28. The buckle 30 is deemed to be conventional and is a common type of buckle that is in relatively widespread use. One end of a belt 34 is connected to the female section 28 with the opposite end of the belt connecting with the male section 32. The buckle 30 is to provide for adjustment of the belt 34 so as to accomodate to different waist sizes of swimmers 36.

The swimming harness 22, as previously mentioned, is composed of an integral length of braided cord 38. This cord 38 is constructed to be tubular forming an internal chamber 40. The weave of the cord is such that when the cord is stretched, the cord will slightly collapse making the internal chamber 40 slightly smaller.

If the cord 38 is longitudinally condensed it will expand in cross-section forming an enlarged internal chamber 42. This enlarged internal chamber 42 is formed within an enlarged section 44 of the cord 38. Located within the internal chamber 42 and annularly spaced therefrom is an elastic solid cord 46. Normally, this cord 46 will be constructed of rubber or a similar type of stretchable material. Each end of the cord 46 is fixedly secured to the braided cord 38 by means of a clamping ring 48. Enclosing about a portion of the braided cord 38 in the area of the clamping ring 48 is a covering sleeve 50. Typical material for the sleeve 50 would be a rubber-type of material.

Figure 4:
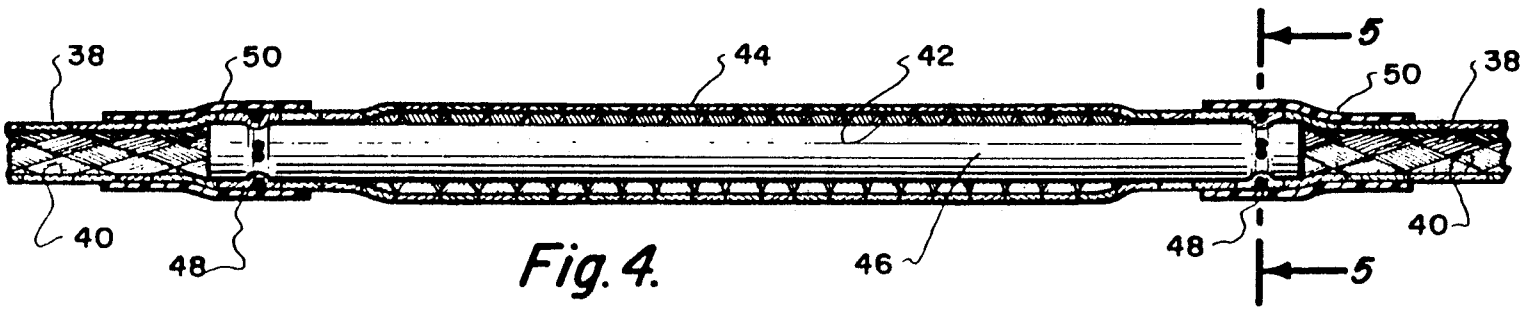
FIG. 4 is a cross-sectional view through the enlarged section taken along line 4—4 of FIG. 3.
Figure 5:
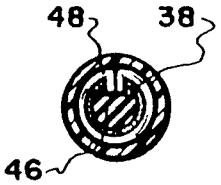
FIG. 5 is a transverse cross-sectional view taken along line 5—5 of FIG. 4 showing in more detail the securement between the braided cord and an end of the stretchable solid cord mounted within the enlarged section.
Figure 2:
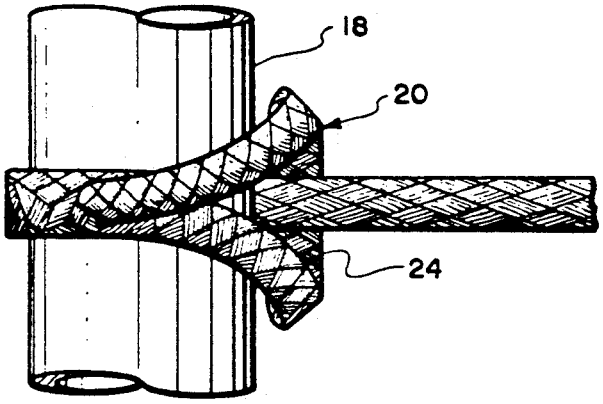
FIG. 2 is an enlarged view of the inner end of the swimming harness showing such being connected to a fixed structure which is mounted on the side wall of the swimming pool.
Figure 6:
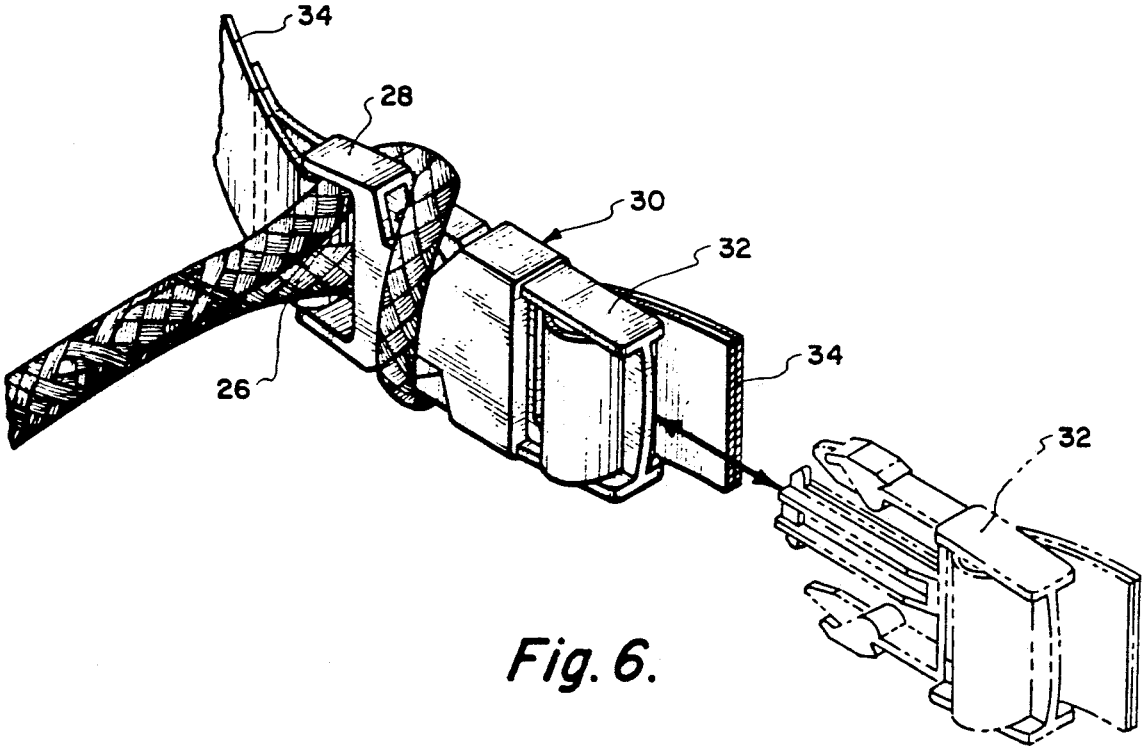
FIG. 6 is an enlarged isometric view of the outer end of the swimming harness depicting the attachment of such to the swimmer.

When there is no longitudinal force being applied to the swimming harness 22, the solid cord 46 is in an unstretched configuration as is shown within FIG. 4 of the drawings. In this unstretched configuration the enlarged section 44 is located spaced from the body of the cord 46. Now let it be assumed that a longitudinal force has been applied to the swimming harness 22 as would occur when the swimmer 36 imparts a jerking motion to the harness 22. The cord 46 will stretch longitudinally. When this occurs, the enlarged section 44 will also be stretched and as it is stretched will diminish in cross-sectional size so that the space between the enlarged section 44 and the cord 46 will diminish. The condensing of the cord 38 confined within section 44 is preselected so as to limit the amount of stretch of the cord 46. In actual practice, the enlarged section 44 will permit the cord 46 to stretch approximately two to six inches.

Although the swimming harness of this invention is shown attached to a ladder 18, it is considered to be within the scope of this invention that the harness could be attached to any fixed object such as a tree, a fixed chair, etc. The braided cord 38 acts to protect against injury if the solid cord 46 breaks during usage.

What is claimed is:

1. A swimming harness for restraining a swimmer in a swimming pool yet permitting the swimmer the freedom of swimming movement, said swimming harness comprising:

an elongated integral braided cord having an inner end and an outer end, said inner end being secured to a fixed object located directly adjacent the swimming pool, said outer end being secured to the swimmer, said elongated integral braided cord being hollow defining an internal chamber, a portion of said internal chamber being enlarged forming an enlarged section which is substantially greater in cross-sectional size than the remaining portion of said cord, said enlarged section being spaced from both said inner end and said outer end; and a resilient solid cord mounted within said enlarged section, said resilient solid cord being elastic, said resilient solid cord having ends which are tightly secured to said braided cord just exteriorly of said enlarged section, said resilient solid cord being stretchable from an at-rest position to an extended position, with said resilient solid cord in said at-rest position there being an annular space between said resilient solid cord and said enlarged section of said elongated integral braided cord, as said resilient solid cord moves from said at-rest position to said extended position said space decreases in size which is located between said resilient solid cord and said enlarged section, whereby as the swimmer applies a jerking force to said swimming harness, the jerking force is absorbed by said solid cord smoothing out the movements of the swimmer.

2. The swimming harness as defined in claim 1 wherein:

said enlarged section functioning to limit the amount of stretching movement of said resilient solid cord.

* * * * *